US008753741B2

(12) United States Patent
Bates

(10) Patent No.: US 8,753,741 B2
(45) **Date of Patent: *Jun. 17, 2014**

(54) POLY(TRIMETHYLENE ARYLATE) FIBERS, PROCESS FOR PREPARING, AND FABRIC PREPARED THEREFROM

(75) Inventor: W. Douglas Bates, Wilmington, DE (US)

(73) Assignee: E I du Pont de Nemours and Company, Wilmington, DE (US)

( * ) Notice: Subject to any disclaimer, the term of this patent is extended or adjusted under 35 U.S.C. 154(b) by 49 days.

This patent is subject to a terminal disclaimer.

(21) Appl. No.: 13/269,058

(22) Filed: Oct. 7, 2011

(65) Prior Publication Data

US 2012/0028528 A1 Feb. 2, 2012

Related U.S. Application Data

(63) Continuation-in-part of application No. 12/767,911, filed on Apr. 27, 2010, now abandoned.

(51) Int. Cl.
*D02G 3/00* (2006.01)

(52) U.S. Cl.
USPC ..... 428/373; 57/200; 57/243; 57/252; 264/103; 264/168; 264/143; 264/172.11; 264/172.13; 264/172.17; 264/172.18; 264/210.8; 264/211; 264/211.12; 428/359; 428/364; 428/370; 428/372; 428/374; 525/165; 525/166; 525/177; 525/190; 525/445

(58) Field of Classification Search
USPC ..... 57/200, 243, 252; 264/103, 168, 143, 264/172.11, 172.13, 172.17, 172.18, 210.8, 264/211, 211.12; 428/359, 364, 370, 372, 428/373, 374; 525/165, 166, 177, 190, 445
See application file for complete search history.

(56) References Cited

U.S. PATENT DOCUMENTS

| | | | |
|---|---|---|---|
| 5,993,712 | A | 11/1999 | Wandel et al. |
| 6,136,435 | A | 10/2000 | Yoshimura et al. |
| 6,287,688 | B1 | 9/2001 | Howell et al. |
| 6,923,925 | B2 | 8/2005 | Chang et al. |

FOREIGN PATENT DOCUMENTS

| | | | |
|---|---|---|---|
| JP | 11189925 | A | 7/1999 |
| JP | 2001151997 | A | 6/2001 |
| WO | 2004003270 | A2 | 1/2004 |
| WO | 2011022616 | A1 | 2/2011 |
| WO | 2011022624 | A1 | 2/2011 |

OTHER PUBLICATIONS

Kadolph, Sara and Langford, Anna., Textiles, 1998,p. 173-242, 261, 393, 400-401, and 410, Prentice Hall, Upper Saddle River, NJ.

Chuah, Hoe H., Intrinsic Birefringence of Poly(trimethylene terephthalate), Journal of Polymer Science: Part B: Polymer Physics, 2002, pp. 1513-1520, vol. 40.

Uster Tester 4, Technical Data, Jul. 2003, pp. 1-12.

International Search Report dated Jul. 12, 2012, International Application No. PCT/US2011/055404.

*Primary Examiner* — Robert Jones, Jr.

(57) ABSTRACT

A fine denier poly(trimethylene arylate) spun drawn fiber is characterized by high denier uniformity. A process for preparing uniform fine denier yarns at spinning speeds of 4000 to 6000 m/min is further disclosed. The poly(trimethylene arylate) fiber hereof comprises 0.1 to 3% by weight of polystyrene dispersed therewithin. Fabrics prepared therefrom are also disclosed.

8 Claims, 6 Drawing Sheets

POLY(TRIMETHYLENE ARYLATE) FIBERS, PROCESS FOR PREPARING, AND FABRIC PREPARED THEREFROM

FIELD OF THE INVENTION

This invention relates to a process for spinning poly(trimethylene arylate) fibers, the resultant fibers, and their use.

BACKGROUND

Poly(trimethylene arylate), particularly poly(trimethylene terephthalate) (also referred to as 3GT, Triexta or PTT), has recently received much attention as a fiber-forming polymer useful in textiles. PTT fibers have excellent physical and chemical properties. Continuous textured polyester yarns, prepared from partially oriented polyester yarns (POY) or spun drawn yarns (SDY), mostly polyethylene terephthalate (PET), are in wide-spread commercial use in many textile applications, such as knit and woven fabrics, as well as non-woven fabrics, such as spunbonded PET. The textile term "yarn" refers to a bundle of individual fibers. For example, shirts and blouses are often made from yarns made up of bundles of 30-40 filaments.

Polyester yarns, including both PET and PTT yarns, are prepared by a so-called melt spinning process, and are said to be "melt spun." Melt spinning is a process whereby the polymer is melted and extruded through a hole in a so-called spinneret. In typical textile applications, the spinneret is provided with a plurality of holes, often 30-40, each about 0.25 mm in diameter. Multiple filaments are thereby extruded from a single spinneret. Those filaments are combined to form a bundle that is called a yarn.

Polyester yarns can be used in any combinations with or without other types of yarns. Thus, polyester yarns can make up an entire fabric, or constitute the warp, weft or fill, in a woven fabric; or as one of two or more yarns in a yarn blend, for instance, with cotton, wool, rayon, acetate, other polyesters, spandex and/or combinations thereof.

Fujimoto et al., U.S. Pat. No. 6,284,370, discloses a process for preparing 1-2 dpf PTT fibers wherein a first roll is heated to 30-80° C., a second roll is heated to 100-160° C., and the draw ratio imposed between the first and second rolls was is in the range of 1.3-4. In 13 examples and 11 counter-examples, Fujimoto never heated the first roll to a temperature above 60° C. except in one counterexample. In all the example, the first roll temperature was in the range of 50-60° C.

Ding, U.S. Pat. No. 7,785,507, discloses a process for preparing 2-3 dpf PTT fibers wherein a first godet is heated to 85-160° C., a second godet is heated to 125-195° C., and the draw ratio imposed between the first and second rolls was in the range of 1.1-2. Ding teaches that a first godet temperature of 75° C. caused excessive line breaks. Uster results were ca. 0.90-0.95%. In all the examples, the temperature of the first godet was 90° C. or more.

Howell et al., U.S. Pat. No. 6,287,688, describes preparation of textured PTT yarns that exhibit increased stretch, luxurious bulk and improved hand, as compared to PET yarns. Howell et al. describes preparing partially oriented PTT yarns at spinning speeds up to 2600 m/m. By contrast, PET is routinely melt spun at several times that speed. For reasons of cost, it is highly desirable to be able to spin PTT yarns at speeds higher than 2600 m/min.

Chang et al., U.S. Pat. No. 6,923,925, discloses a composition comprising PTT containing about 2% polystyrene (PS) that can be melt spun into spun drawn yarns at speeds up to 5000 m/min. Chang et al. is completely silent in regard to the denier uniformity (Denier CV) of the yarns so produced, and silent as well regarding the temperatures of the godet rolls employed for preparing the spun drawn yarn.

There is a need for a low denier spun-drawn filament yarn of PTT that can be spun at commercially viable spinning speeds and that is of sufficient denier uniformity to have practical utility in the preparation of high quality fabrics and garments.

SUMMARY OF THE INVENTION

In a first aspect, the present invention provides a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055.

In one embodiment, the poly(trimethylene arylate) is poly (trimethylene terephthalate).

In another aspect, the present invention provides a process for forming a novel spun drawn filament characterized by a denier per filament of ≤3, and a denier coefficient of variation of ≤2.5, the process comprising extruding a polymer melt comprising 0.1 to 3% by weight, based on the total weight of polymer, of polystyrene dispersed in poly(trimethylene arylate), through an orifice having a cross-sectional shape, thereby forming a continuous filamentary extrudate, quenching the extrudate to solidify it into a continuous filament, wrapping the filament on a first driven roll heated to a temperature in the range of 70 to 100° C. and rotating at a first rotational speed, followed by wrapping the filament on a second driven roll heated to a temperature in the range of 100 to 130° C. and rotating at a second rotational speed; and, winding said filament onto a take-up roll at a linear speed of at least 4,000 meters/minute (m/min); wherein the ratio of the first rotational speed to the second rotational speed lies in the range of 1.75 to 3; thereby forming a spun drawn filament having a denier per filament of ≤3, and a denier coefficient of variation of ≤2.5%.

In one embodiment, the poly(trimethylene arylate) is poly (trimethylene terephthalate).

In another aspect, the present invention provides a fabric comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055.

In one embodiment, the poly(trimethylene arylate) is poly (trimethylene terephthalate).

DETAILED DESCRIPTION OF THE INVENTION

Figure 1:
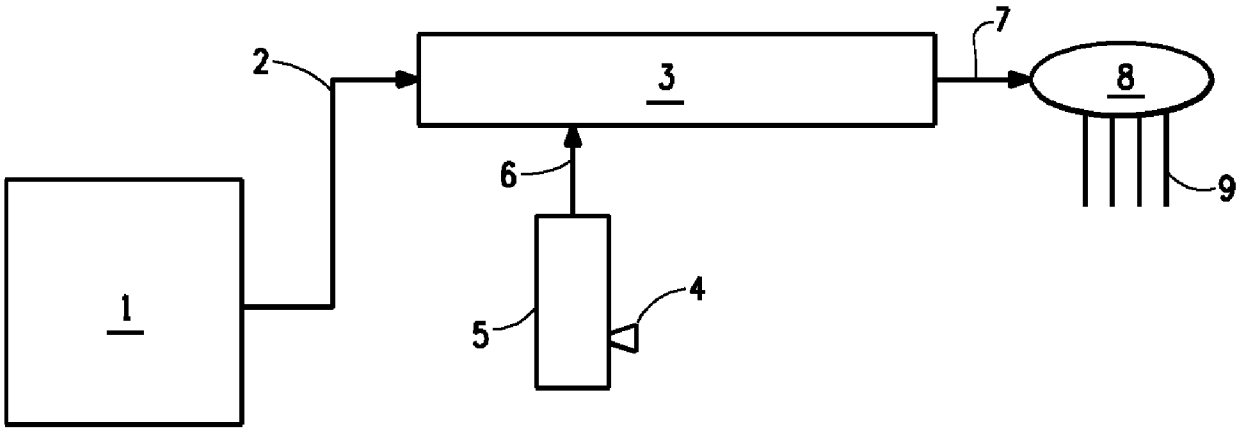
FIG. 1 is a schematic representation of one embodiment of melt feeding a spinneret according to the invention.

In one aspect, the present invention is directed to a filament comprising a composition comprising 0.1 to 3% by weight of polystyrene, based on the total weight of the polymer in the composition, dispersed in poly(trimethylene arylate) wherein the filament is characterized by a denier per filament (dpf) of ≤3, a denier coefficient of variation (denier CV) of ≤2.5% and a birefringence of at least 0.055.

In one embodiment, the poly(trimethylene arylate) is poly (trimethylene terephthalate).

In one embodiment, the filament hereof is a continuous filament. In an alternative embodiment, the filament hereof is a staple filament. In one embodiment, a plurality of the filaments hereof are combined to form a multifilament yarn. The multifilament yarn thus formed is suitable for texturing, and for end uses in those textile applications in which fine denier yarns are desirable, such as shirts, blouses, lingerie, hosiery and the like.

The multifilament yarn hereof is useful for forming knitted, woven, and non-woven fabrics by methods known in the art.

In an alternative embodiment, the filament hereof is also suitable for use in a wide variety of non-woven constructions. The filament hereof can be arrayed in a random or quasi-random web to form a filamentary non-woven fabric. In a further embodiment, the filamentary non-woven fabric comprises a plurality of continuous filament strands hereof. In an alternative further embodiment, the filamentary non-woven fabric comprises a single continuous filament strand. In an alternative embodiment, the filamentary non-woven fabric comprises a plurality of staple filaments prepared from the filament hereof. A filamentary non-woven fabric for the purposes of the present invention is a non-woven fabric whereof the fundamental structural element is a single randomly or quasi-randomly disposed filament segment rather than a multi-filament yarn segment.

In another aspect, the present invention provides a process for forming a novel spun drawn filament characterized by a denier per filament of ≤3, and a denier coefficient of variation of ≤2.5%, the process comprising extruding a polymer melt comprising 0.1 to 3% by weight, based on the total weight of polymer, of polystyrene dispersed in poly(trimethylene arylate), through an orifice having a cross-sectional shape, thereby forming a continuous filamentary extrudate, quenching the extrudate to solidify it into a continuous filament, wrapping the filament on a first driven roll heated to a temperature in the range of 70 to 100° C. and rotating at a first rotational speed, followed by wrapping the filament on a second driven roll heated to a temperature in the range of 100 to 130° C. and rotating at a second rotational speed; and, winding said filament onto a take-up roll at a linear speed of at least 4,000 meters/minute (m/min); wherein the ratio of the first rotational speed to the second rotational speed lies in the range of 1.75 to 3.

As demonstrated in the examples presented infra, the denier CV of yarns of ≤3 dpf when spun at speeds of 4,000 m/min or more when the first godet is set above 70° C. is conspicuously lower than that of yarns of comparable composition spun at the same speeds when the first godet is set at the commercially typical temperature of 60° C.

The term "denier coefficient of variation" (denier CV) refers to the coefficient of variation in denier determined by a Uster Yarn Evenness tester available from Uster Technologies. The so called "Uster Tester" measures denier variation along the length of a single continuous strand of fiber or yarn. The denier CV is a standard statistical parameter that represents the value obtained by dividing the standard deviation of the denier by the mean denier, determined from the Uster Tester.

In the present invention concentrations are stated in terms of percentages by weight unless otherwise stated. In particular, it shall be understood that the concentration of polystyrene blended with the poly(trimethylene terephthalate) or other poly(trimethylene arylate) hereof is expressed as the percent by weight of polystyrene relative to the total weight of polymer in the composition.

When a range of numerical values is provided herein, it shall be understood to encompass the end-points of the range unless specifically stated otherwise. Numerical values are to be understood to have the precision of the number of significant figures provided as described in ASTM E29-08. For example, the number 3 shall be understood to encompass a range from 2.5 to 3.4, whereas the number 3.0 shall be understood to encompass a range from 2.95 to 3.04.

For the purposes of the present invention, the description shall be directed at those embodiments in which the poly (trimethylene arylate) is poly(trimethylene terephthalate) (PTT) unless otherwise explicitly stated. Extension of the invention to other poly(trimethylene arylates) shall be made with adjustments in concentration by weight appropriate to differences in the molecular weight of the particular arylate monomer units involved, assuming equal degrees of polymerization.

Both homopolymers and copolymers of both polystyrene and PTT are suitable for use in the present invention. For the purposes of the present invention, it shall be understood that the term "copolymer" encompasses not only dipolymers, but terpolymers, tetrapolymers and so forth. The term "copolymer" shall be understood to encompass any number of monomers polymerized together. For practical purposes, the vast majority of applications are limited to homopolymers, dipolymers, and terpolymers.

In one embodiment, the filament comprises a composition comprising 97 to 99.9 wt % of PTT and 3 to 0.1 wt % polystyrene (PS). In another embodiment, the filament comprises a composition comprising 70 to 99.5 wt % of PTT, 3 to 0.5 wt % of PS, and, optionally, up to 29.5 wt % of other polyesters. In another embodiment, the filament comprises a composition comprising 98 to 99.5 wt % of PTT and 2 to 0.5 wt % PS.

In one embodiment, the filament consists essentially of a composition consisting essentially of 97 to 99.9 wt % of PTT and 3 to 0.1 wt % polystyrene (PS). In another embodiment, the filament consists essentially of a composition consisting essentially of 70 to 99.5 wt % of PTT, 3 to 0.5 wt % of PS and, optionally, up to 29.5 wt % of other polyesters. In another embodiment, the filament consists essentially of a composition consisting essentially of 98 to 99.5 wt % of PTT and 2 to 0.5 wt % PS.

Suitable PTT polymer is formed by the condensation polymerization of 1,3-propanediol and terephthalic acid or dimethylterephthalate. One or more suitable comonomers for copolymerization therewith is selected from the group consisting of linear, cyclic, and branched aliphatic dicarboxylic acids or esters having 4-12 carbon atoms (for example butanedioic acid, pentanedioic acid, hexanedioic acid, dodecanedioic acid, and 1,4-cyclohexanedicarboxylic acid, and their corresponding esters); aromatic dicarboxylic acids or esters other than terephthalic acid or ester and having 8-12 carbon atoms (for example isophthalic acid and 2,6-naphthalenedicarboxylic acid); linear, cyclic, and branched aliphatic diols having 2-8 carbon atoms (other than 1,3-propanediol) for example, ethanediol, 1,2-propanediol, 1,4-butanediol, 3-methyl-1,5-pentanediol, 2,2-dimethyl-1,3-propanediol, 2-methyl-1,3-propanediol, and 1,4-cyclohexanediol; and aliphatic and aromatic ether glycols having 4-10 carbon atoms, for example, hydroquinone bis(2-hydroxyethyl)ether, or a poly (ethylene ether) glycol having a molecular weight below 460, including diethyleneether glycol. The comonomer typically is present in the PTT copolymer at a level in the range of 0.5-15 mole %, and can be present in amounts up to 30 mole %.

The PTT can contain minor amounts of other comonomers selected so that they do not have a significant adverse affect on properties. Such other comonomers include 5-sodium-sulfoisophthalate, for example, at a level in the range of 0.2 to 5 mole %. Very small amounts of trifunctional comonomers, for example trimellitic acid, can be incorporated for viscosity control. The PTT can be blended with up to 30 mole percent of other polymers. Examples are polyesters prepared from other diols, such as those recited supra.

In one embodiment, the PTT contains at least 85 mol-% of trimethylene terephthalate repeat units. In a further embodiment, the PTT contains at least 90 mol-% of trimethylene terephthalate repeat units. In a still further embodiment the PTT contains at least 98 mol-% of trimethylene terephthalate repeat units. In a still further embodiment the PTT contains 100 mol % of trimethylene terephthalate repeat units.

In one embodiment, suitable PTT is characterized by an intrinsic viscosity (IV) in the range of 0.70 to 2.0 dl/g. In a further embodiment, suitable PTT is characterized by an IV in the range of 0.80 to 1.5 dl/g. In a still further embodiment, suitable PTT is characterized by an IV in the range of 0.90 to 1.2 dl/g.

In one embodiment, suitable PTT is characterized by a number average molecular weight ($M_n$) in the range of 10,000 to 40,000 Da. In a further embodiment suitable PTT is characterized by $M_n$ in the range of 20,000 to 25,000 Da.

In one embodiment, a suitable polystyrene is selected from the group consisting of polystyrene homopolymer, α-methylpolystyrene, and styrene-butadiene copolymers, and blends thereof. In one embodiment, the polystyrene is a polystyrene homopolymer. In a further embodiment, the polystyrene homopolymer is characterized by $M_n$ in the range of 5,000 to 300,000 Da. In a still further embodiment, $M_n$ of the polystyrene homopolymer is in the range of 50,000 to 200,000 Da. In a still further embodiment $M_n$ of the polystyrene homopolymer is in the range of 75,000 to 200,000 Da. In a still further embodiment, $M_n$ of the polystyrene homopolymer is in the range of 120,000 to 150,000 Da. Useful polystyrenes can be isotactic, atactic, or syndiotactic. High molecular weight atactic polystyrene homopolymer is preferred.

Polystyrenes useful in this invention are commercially available from many suppliers including Dow Chemical Co. (Midland, Mich.), BASF (Mount Olive, N.J.) and Sigma-Aldrich (Saint Louis, Mo.).

PTT and PS are melt blended and, then, extruded in the form of a strand that is subsequently cut into pellets. Other forms of melt blending and subsequent comminution, such as into flake, chips, or powder, can also be performed. Under some circumstances it may be convenient to prepare pellets comprising a first PTT/PS blend with a concentration of PS greater than 15% followeb by remelting the pellets and diluting the remelt with additional PTT to form a second melt blend having a concentration of PS that is ≤3%, and to extrude the second melt blend into the filament hereof.

The filament hereof comprises a composition comprising PTT and PS. In some embodiments, these will be the only two materials in the blend and they will total 100 weight %. However, in many instances the blend will have other ingredients such as are commonly included in polyester polymer compositions in commercial use. Such additives include but are not limited to other polymers, plasticizers, UV absorbers, flame retardants, dyestuffs, and so on. Thus the total of the poly(trimethylene terephthalate) and polystyrene will not be 100 weight %. Other polymers can include for example polyamides that impart acid dyeability to the yarn blend. In those instances in which additional, non-polyester, polymers are added, the ratios of polyester to PS weight percent concentrations remain the same as for those compositions that do not include the other polymers.

According to the present invention, the PS is in the form of particles having an average size of less than 500 nanometers. In one embodiment, the polystyrene is polystyrene homopolymer at a concentration of ≤2%; and, the poly (trimethylene arylate) is PTT comprising at least 98 mol % of trimethylene terephthalate monomer units.

The filament of the present invention is characterized by a dpf ≤3, a denier CV of ≤2.5%, and a birefringence of at least 0.055. Typical physical properties of the filament hereof include a tenacity above 3 grams per denier, and an elongation to break of 30 to 70%. In one embodiment, the filament denier is ≤2.5. In another embodiment, the birefringence is at least 0.060.

In another aspect, this invention is directed to a process for preparing a single or multifilament yarn comprising (a) preparing a melt blend consisting essentially of PTT and 0.1 to 3 weight % (wt %) polystyrene (PS), (b) melt spinning the polymer melt blend so prepared to form one or more filaments of PTT containing dispersed PS.

The filament of the present invention is conveniently prepared as a spun drawn filament—that is, a filament that has been fully drawn in the spinning process. By fully drawn is meant that the filament after quenching has been elongated close to the ultimate elongation to break thereof. Preferably, the spinning comprises extruding the polymer blend hereof through the one or more holes of a spinneret at a spinning speed of at least 4,000 m/m. The term "spinning speed" refers to the rate of spun fiber accumulation, such as on a mechanical wind-up.

The high birefringence of ≥0.055 that is characteristic of the filament of the invention is a direct result of the high draw applied to the filament in the spun-draw process. High birefringence is a principle way of distinguishing spun-drawn filaments from partially-oriented spun yarn that is subsequently draw-textured.

FIG. 1 is a schematic representation of one embodiment of a melt spinning machine suitable for use in the present invention. Referring to FIG. 1, PTT is produced in a continuous melt polymerizer, 1, from which it is conveyed in molten form via transfer line, 2, to a counter-rotating twin-screw extruder, 3, the twin screw extruder being provided with a mixing zone. Simultaneously, pellets comprising PS are fed via a weight-loss feeder, 4, or other pellet feeder means, to a satellite extruder, 5, wherein the pellet is melted and fed in molten form via transfer line, 6, to twin-screw extruder, 3, either at or upstream from the mixing zone of the twin-screw extruder, 3. In the twin-screw extruder a PTT/PS melt blend is formed. The resulting melt blend is fed via transfer line, 7, to a spin block comprising a spinneret, 8, from which one or more continuous filaments, 9, are extruded.

Figure 2:
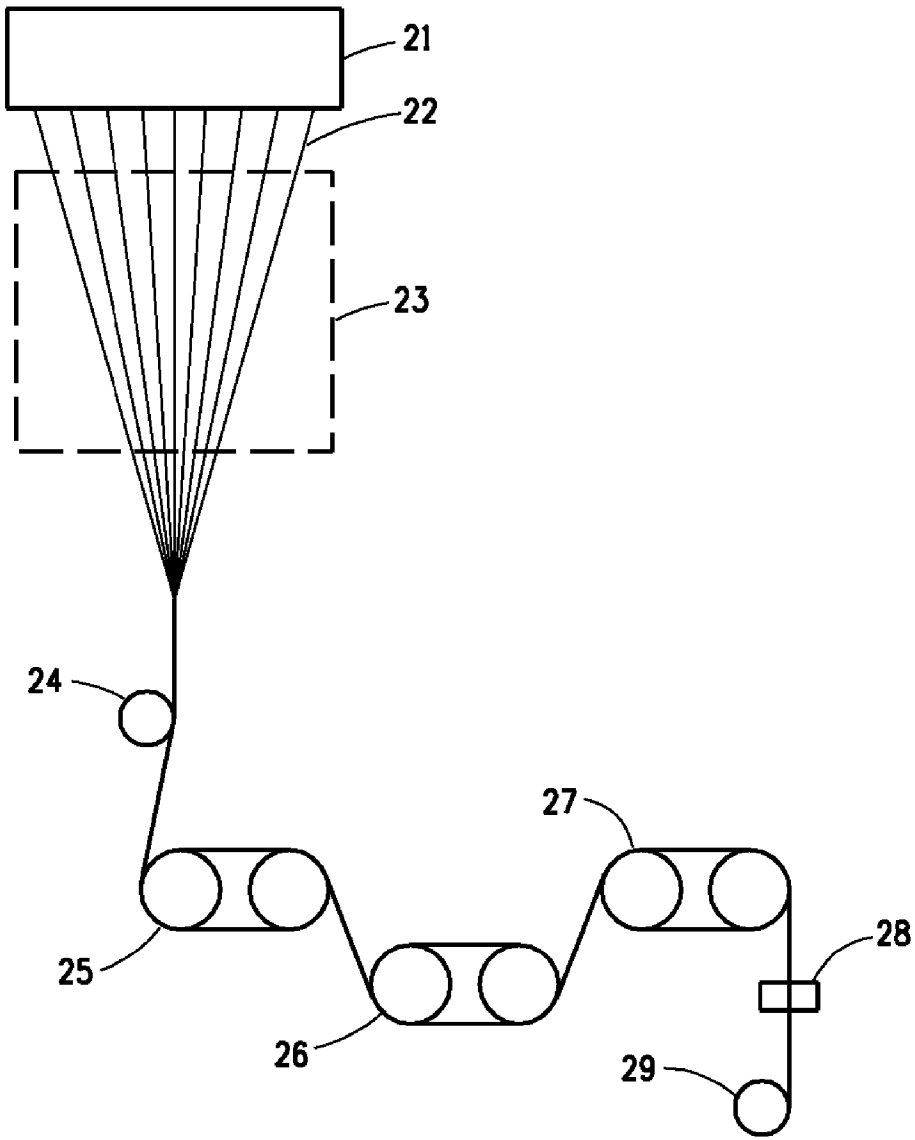
FIG. 2 is a schematic representation of one embodiment of the fiber spinning process according to the invention.

FIG. 2 depicts one suitable arrangement for melt spinning according to the invention. 34 filaments 22, (all 34 filaments are not shown) are extruded through a hole spinneret 21. The filaments pass through a cooling zone 23, are formed into a yarn bundle, and passed over a finish applicator 24. The cooling zone comprises an air quench zone wherein air is impinged upon the yarn bundle at room temperature and at 60% relative humidity with a velocity of 40 feet/min. The air quench zone can be designed for so-called cross-air-quench wherein the air flows across the yarn bundle, or for so-called radial quench wherein the air source is in the middle of the converging filaments and flows radially outward over 360°. Radial quench is a more uniform and effective quench method. Following the finish applicator 24, the yarn is passed to a first driven godet roll 25, also known as a feed roll, set at 60 to 100° C., in one embodiment, 70 to 100° C., coupled with a separator roll. The yarn is wrapped around the first godet roll and separator roll 6 to 8 times. From the first godet roll, the yarn is passed to a second driven godet roll, also known as a draw roll, set at 110 to 130° C., coupled with a second separator roll. The yarn is wrapped around the second godet roll and separator roll 6 to 8 times. Draw roll speed is 4000 to 6000 m/min while the ratio of draw roll speed to feed roll speed is in the range of 1.75 to 3. From the draw rolls, the yarn is passed to a third driven godet roll 27, coupled with a third separator roll, operated at room temperature and at a speed 1-2% faster than the roll speed of the second godet roll. The yarn is wrapped around the third pair of rolls 6 to 10 times. From the third pair of rolls, the yarn is passed though an interlace jet 28, and then to a wind-up 29, operated at a speed to match the output of the third pair of rolls.

Referring to FIG. 2, according to the process hereof, a quenched filament is wound at least once but preferably a plurality of times around the first godet roll so that the first godet roll applies a drawing force on the extruded filament, causing it to draw down before quenching; down stream from the first godet roll, the filament is wrapped at least once but preferably a plurality of times around a second godet roll in such manner that the second godet applies a drawing force on that portion of the filament lying between the first and second godet rolls. In the embodiment depicted in FIG. 2, from the second godet roll, the filament is directed to a third godet roll which serves as a let down roll, running at a speed 1-2% higher than that of the second (draw) godet roll. From the third godet, the filament is directed to a wind-up. The rate at which the filament is wound on the wind-up is described as the spinning speed. In typical installations, the wind-up is a tension controlled wind-up.

According to the present invention, the first godet roll is heated to a temperature in the range of 70-100° C. and the second godet roll is heated to a temperature in the range of 100-130° C. The first godet roll is driven at a first rotational speed; the second godet roll is driven at a second rotational speed. According to the present invention the ratio of the second rotational speed to the first rotational speed (the draw ratio) falls within the range of 1.75 to 3.

In one embodiment, a plurality of filaments, each individually of the invention, are extruded through a multi-hole spinneret. The filaments so extruded are combined to form a yarn. Typically the yarn is held together by the application of some agitation, twisting, or both, of the extruded filaments, or thread line, causing the interlacing of the filaments. The yarn so formed comprises a plurality of filaments, each filament characterized by a dpf ≤3, a denier CV of ≤2.5%, and a birefringence of at least 0.055. In one embodiment, the filament denier is ≤2.5. In another embodiment, the birefringence is at least 0.060. Typical yarns comprise 34, 48, 68, and 72 filaments, although the number of filaments combined to make a yarn is not limited in any way.

Yarns formed according to the present invention are not limited only to be made up of a plurality of filaments according to the invention, but can contain other filaments as well. For example, a yarn formed according to the invention can contain other filaments of other polyesters as well as polyamides, polyacrylates and other such filaments as may be desired. The other filaments can also be staple fibers.

The yarn formed according to the invention, which can be formed by the spun-draw process described supra, is suitable for use as a feed yarn for false twist texturing as commonly practiced in order to provide textile-like aesthetics to continuous polyester fibers. While there are several types of texturing equipment, all well-known in the art, the texturing process comprises a) providing a yarn package as formed according to the spinning process described supra; (b) unwinding the yarn from the package, (c) threading the yarn end through a friction twisting element or false-twist spindle, d) causing the spindle to rotate, thereby imparting twist in the yarn upstream of the rotating spindle and untwisting the upstream twist downstream from the rotating spindle along with the application of heat; and (e) winding the yarn onto a package.

The invention enables an increase in productivity in the spinning of fine denier (≤3 dpf) spun-drawn PTT yarns. The filament and yarn thereof of the invention have been prepared at spinning speeds that are 30 to 70% higher than the maximum spinning speed achievable with neat PTT. The resulting yarn is characterized by an elongation and tenacity within 20% of the elongation and tenacity of a PTT multifilament yarn that only differs from the yarn of the invention in that it does not contain the PS (and that has necessarily been spun at about 3000 m/min). Thus, the yarns consisting essentially of the filaments of the invention are useful in a wide variety of textile applications with only minor adjustments needed in the textile machinery being used. The resultant yarns are useful in preparing inter alia textured yarns, fabrics and carpets, under the same or similar conditions to those used for PTT yarns not containing PS and prepared at 3000 m/min.

In the filament of the invention, the PTT is a continuous phase or "matrix" and the PS is a discontinuous phase dispersed within the PTT matrix. In one embodiment, the size of the PS particles dispersed in the PTT matrix is ≤500 nm. In a further embodiment, the size of the PS particles dispersed in the PTT matrix is ≤200 nm.

The beneficial features of the present invention include the ability to spin a fine denier, high strength, tough, spun drawn PTT yarn at spinning speeds of 4000 m/min or higher. These beneficial features depend upon both the fine particle size of PS and the volume homogeneity of the dispersion of PS in the PTT that in turn depend upon the application of sufficiently high shear melt blending. There is no threshold particle size at which the spinning performance and/or physical properties of the spun yarn suddenly degrades. Rather, as the PS particle size gets larger, performance gradually deteriorates. At particle sizes in the range of 500 nm or larger, denier CV gets progressively larger. Similarly, there is no particular threshold of homogeneity in regard to particle distribution in the PTT matrix. The better the uniformity of dispersion, the more uniform the resulting spun filament will be. One particularly valuable benefit of the present invention is the production of spun-drawn yarns characterized by denier CV of less than 2.5%. Low denier CV is especially important in the preparation of fine denier yarns for textile applications. Unless the process by which the PS is dispersed in PTT is characterized by shear forces sufficient to ensure a particle size less than 500 nm and a sufficiently high uniformity of dispersion, it is highly unlikely that the denier CV will be ≤2.5%.

The amount of shear force applied to the melt depends upon the rotational speed of the mixing elements, the viscosity of the melt, and the residence time of the melt in the mixing zone. If the shear forces are too low there is a tendency for the PS to not break up to begin with, or to agglomerate rapidly into droplets greater than 500 nm in size.

The melt blending process can be performed both batchwise and continuously. So called high shear mixers such as are commonly employed in the art of polymer compounding are suitable. Examples of suitable commercially available high shear batch mixers include, but are not limited to, Banbury mixers and Brabender mixers. Examples of continuous high shear mixers include co-rotating twin-screw extruders and Farrel Continuous Mixers Counter-rotating twin screw extruders are also suitable. In general, suitable high shear mixers are those that are capable of exerting on a polymer melt a minimum shear rate of 50/s, with 100/s preferred. After melt blending the resulting blend can be pelletized for later feeding to a spinning machine, or the melt blend can be fed directly into a spinning machine. Another useful method is to combine polymer melts. An example of this method would be to provide a PTT melt from a continuous polymerizer to the first stage of a twin screw extruder, and feeding a PS melt from a satellite extruder into the mixing zone of the twin screw extruder, thereby creating a melt blend. In another method the unmelted polymers may be dry-mixed, as by tumbling, before being fed to a twin screw extruder for melt blending.

Average particle size greater than 500 nm is not preferred from the standpoint of good fiber spinning performance. Additionally, spinning of uniform filaments, both along a single end, and end to end, depends expressly upon the homogeneity of the volume distribution of the PS particles. While in no way limiting the scope of the invention, it is speculated that in the actual melt processing thereof, the PS particles melt to form molten droplets that are dispersed within a molten PTT matrix.

The temperature in the melt mixer should be above the melting points of both the PTT and the PS but below the lowest decomposition temperature of any of the ingredients. Specific temperatures will depend upon the particular attributes of the polymers employed. In typical practice, melt temperature is in the range of 200° C. to 270° C.

In one embodiment, the concentration of the PS in the PTT/PS blend pellets is in the range of 0.5 to 1.5%.

As indicated in FIG. 1, and as is generally true for melt spinning of polymer fibers, the polymer melt is fed to the spinneret via a transfer line. The melt input to the transfer line from the extruder is in turbulent. However, the spinneret feed must be laminar in order to achieve uniform flow through the plurality of holes in the spinneret. It is in the transfer line that the melt flow shifts from turbulent to laminar.

Filament spinning can be accomplished using conventional apparatus and procedures that are in widespread commercial use. As a practical matter, it is found that for spinning fine denier filaments of 3 dpf or lower, a PS concentration of >3% leads to a degradation in mechanical properties of the fiber so produced. It is further found that at 5% PS, fine denier filaments cannot be melt spun at all.

Prior to melt spinning, the polymer blend pellets are preferably dried to a moisture level of <30 ppm to avoid hydrolytic degradation during melt spinning. Any means for drying known in the art is satisfactory. In one embodiment, a closed loop hot air dryer is employed. Typically, the PTT/PS blend is dried at 130° C. and a dew point of <−40° C. for 6 h. The thus dried PTT/PS polymer blend is melt spun at 250-265° C. into fibers.

In a typical melt spinning process, one embodiment of which is described in detail, infra, the dried polymer blend pellets are fed to an extruder which melts the pellets and supplies the resulting melt to a metering pump, which delivers a volumetrically controlled flow of polymer into a heated spinning pack via a transfer line. The pump must provide a pressure of 10-20 MPa to force the flow through the spinning pack, which contains filtration media (e.g., a sand bed and a filter screen) to remove any particles larger than a few micrometers. The mass flow rate through the spinneret is controlled by the metering pump. At the bottom of the pack, the polymer exits into an air quench zone through a plurality of small holes in a thick plate of metal (the spinneret). While the number of holes and the dimensions thereof can vary greatly, typically a single spinneret hole has a diameter in the range of 0.2-0.4 mm. Spinning is advantageously accomplished at a spinneret temperature of 235 to 295° C., preferably 250 to 290° C.

A typical flow rate through a hole of that size tends to be in the range of 1-5 g/min. Numerous cross-sectional shapes are employed for spinneret holes, although circular cross-section is most common. Typically a highly controlled rotating roll system through which the spun filaments are wound controls the line speed. The diameter of the filaments is determined by the flow rate and the take-up speed; and not by the spinneret hole size.

The properties of the thus produced filaments are determined by the threadline dynamics, particularly in the region between the exit from the spinneret and the solidification point of the filaments, which is known as the quench zone. The specific design of the quench zone, air flow rate across the emerging still motile filaments has very large effects on the quenched filament properties. Both cross-flow quench and radial quench are in common use. After quenching or solidification, the filaments travel at the take-up speed, that is typically 100-200 times faster than the exit speed from the spinneret hole. Thus, considerable acceleration (and stretching) of the threadline occurs after emergence from the spinneret hole. The amount of orientation that is frozen into the spun filament is directly related to the stress level in the filament at the solidification point.

The melt spun filament thereby produced is collected in a manner consistent with the desired end-use. For example, for filament intended to be converted into staple fiber, a plurality of continuous filaments can be combined into a tow that is accumulated in a so-called piddling can. Filament intended for use in continuous form, such as in texturing, is typically wound on a yarn package mounted on a tension-controlled wind-up. According to the invention, the rate of accumulation is at least 4,000 m/min.

Texturing imparts crimp by twisting, heat setting, and untwisting by the process commonly known as false twist texturing. These multifilament yarns (also known as "bundles") comprise the same number of filaments as the spun drawn yarns from which they are made. Thus, they preferably comprise at least 10 and even more preferably at least 25 filaments, and typically can contain up to 150 or more, preferably up to 100, more preferably up to 80 filaments. The yarns typically have a total denier of at least 1, more preferably at least 20, preferably t least 50, more preferably up to 250, and up to 1,500. Filaments are preferably at least 0.1 dpf, more preferably at least 0.5 dpf, more preferably at least 0.8 dpf, and most preferably up to 3 dpf.

PTT staple fibers can be prepared by melt spinning the PTT/PS-blend at a temperature of 245 to 285° C. into filaments, quenching the filaments, drawing the quenched filaments, crimping the drawn filaments, and cutting the filaments into staple fibers, preferably having a length of 0.2 to 6 inches (0.5 to 15 cm). One preferred process comprises: (a) providing a polymer blend comprising PTT and 0.1 to 3 PS, (b) melt spinning the melted blend at a temperature of 245 to 285° C. into filaments, (c) quenching the filaments, (d) drawing the quenched filaments, (e) crimping the drawn filaments using a mechanical crimper at a crimp level of 8 to 30 crimps per inch (3 to 12 crimps/cm), (f) relaxing the crimped filaments at a temperature of 50 to 120° c., and (g) cutting the relaxed filaments into staple fibers, preferably having a length of 0.2 to 6 inches (0.5 to 15 cm). In one preferred embodiment of this process, the drawn filaments are annealed at 85 to 115° C. before crimping. Preferably, annealing is carried out under tension using heated rollers. In another preferred embodiment, the drawn filaments are not annealed before crimping. Staple fibers are useful in preparing textile yarns and textile or nonwoven fabrics, and can also be used for fiberfill applications and making carpets.

While the invention is primarily described with respect to multifilament yarns, it should be understood that the preferences described herein are applicable to monofilaments.

The filaments can be round or have other shapes, such as octalobal, delta, sunburst (also known as sol), scalloped oval, trilobal, tetra-channel (also known as quatra-channel), scalloped ribbon, ribbon, starburst, etc. They can be solid, hollow or multi-hollow.

In another aspect, the invention provides a fabric comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055. In one embodiment, the poly(trimethylene arylate) is poly(trimethylene terephthalate).

In one embodiment the filaments are bundled into yarns, and the fabric is a woven fabric. In an alternative embodiment, the filaments are bundled into at least one yarn, and the fabric is a knit fabric. In still another embodiment, the fabric is a nonwoven fabric; in a further embodiment the fabric is a spunbonded fabric.

In one definition, a nonwoven fabric is a fabric that is neither woven nor knit. Woven and knit structures are characterized by a regular pattern of interlocking yarns produced either by interlacing (wovens) or looping (knits). In both cases, yarns follow a regular pattern that takes them from one side of the fabric to the other and back, over and over again. The integrity of a woven or knitted fabric is created by the structure of the fabric itself.

In nonwovens, most commonly filaments are laid down in a random pattern and bonded to one another by chemical or thermal means rather than mechanical means. One commercially available example of a nonwoven produced by such means is Sontara® Spun-Bonded Polyester available from the DuPont Company. In some cases nonwovens can be produced by laying down layers of fibers in a complex three dimensional topological array that does not involve interlacing or looping and in which the fibers do not alternate from one side to the other, as described in Popper et al., U.S. Pat. No. 6,579,815.

Woven fabrics are made with a plurality of yarns interlaced at right angles to each other. The yarns parallel to the length of the fabric are called the "warp" and the yarns orthogonal to that direction are called the "filling" or "weft." Each warp yarn is called an "end." As can be seen in any fabric or clothing store, tremendous variations in aesthetics can be achieved by variations in the specific ways the yarns are interlaced, the denier of the yarns, the aesthetics, both tactile and visual, of the yarns themselves, the yarn density, and the ratio of warp to filling yarns. As a general rule, the structure of a woven fabric imparts a certain degree of rigidity to the fabric; a woven fabric does not in general stretch as much as a knitted fabric.

In the woven fabrics of the invention, at least a portion of the warp comprises yarns comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055. In one embodiment, the poly(trimethylene arylate) is poly(trimethylene terephthalate).

In one embodiment, both the warp and fill comprise yarns comprising the filament hereof. In one embodiment, the warp comprises at least 40% by number of yarns comprising the filament hereof and at least 40% by number of cotton yarns. In one embodiment the warp comprises at least 80% by number of yarns comprising the filament hereof, and the fill comprises at least 80% cotton yarn. As a general rule, there are greater physical demands place upon warp yarns than fill yarns.

Figure 3A:
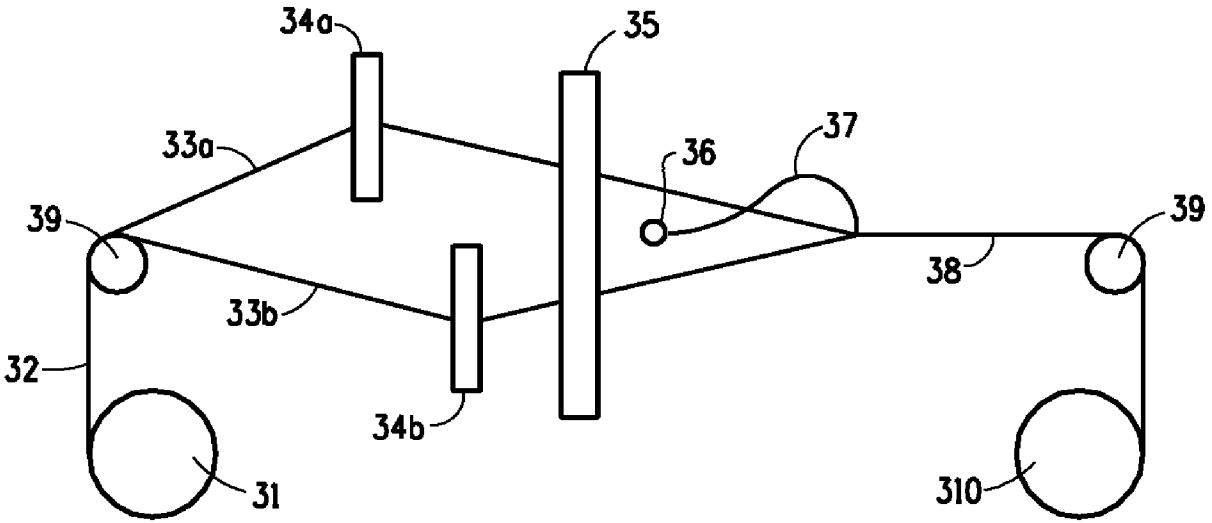
FIG. 3 depicts a loom suitable for fabricating a woven fabric of the invention.
Figure 3B:
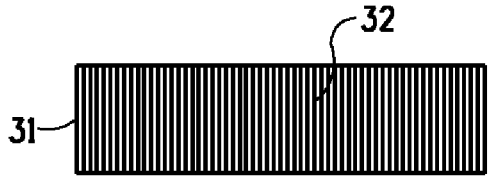
Figure 3C:
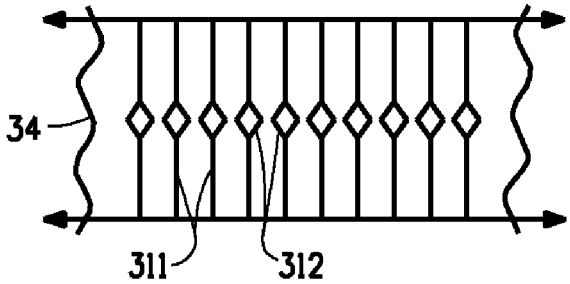
Figure 3D:
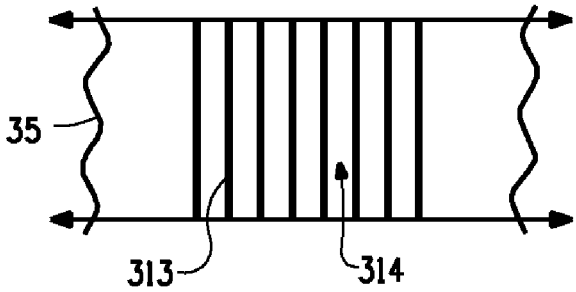

Woven fabrics are fabricated on looms, as they have been for thousands of years. While the loom has undergone tremendous changes, the basic principles of operation remain the same. FIG. 3*a* is a schematic depiction of an embodiment of a loom, shown in side view. A warp beam, 31, made up of a plurality, often hundreds, of parallel ends, 32, is positioned as the loom feed. Warp beam, 31, is shown in front view in FIG. 3*b*. Shown in FIG. 3*a* is a two harness loom. Each harness, 34*a*, and 34*b*, is a frame that holds a plurality, often hundreds, of so called "heddles." Referring to FIG. 3*c*, showing a front, blowup view of a harness, 34, each heddle, 311, is a vertical wire having a hole, 312, in it. The harnesses are disposed to move up or down, one moving up while the other moves down. A portion of the ends, 33*a*, are threaded through the holes, 312, in the heddles, 311, of upper harness, 34*a*, while another portion of the ends, 33*b*, are threaded through the holes in the heddles of lower harness, 34*b*, thereby opening up a gap between the ends 33*a* and 33*b*. In the type of loom shown, a shuttlecock, 36, is impelled by means not shown—typically wooden paddles—to move or shuttle from side to side as the harnesses move up and down. The shuttlecock carries a bobbin of filler yarn, 37, that unwinds as the shuttlecock moves through the gap in the warp ends. A so-called "reed" or "batten," 35, is a frame that holds a series of vertical wires between which the ends pass freely. FIG. 3*d* shows the reed, 35, in front view depicting the vertical wires, 313, and the spaces between, 314, through which the warp yarns pass. The thickness of the vertical wires, 314, determines the spacing of and therefore density of warp yarns in the crossfabric direction. The reed serves to push the newly inserted filler yarn to the right in the diagram into place in the forming fabric, 38. The fabric is wound onto the fabric beam, 310. The rolls, 39, are guide rolls.

The winding of a warp beam is a precision operation in which typically the same number of yarn packages or spools as the desired number of ends are mounted on a so-called creel, and each end is fed onto the warp beam through a series of precision guides and tensioners, and then the entire warp beam is wound at once.

The specific patterns of interlacing ratios of warp to fill yarns determine the type of woven fabric prepared. Basic patterns include plain weave, twill weave, and satin. Numerous other, fancier woven patterns are also known.

Knitting is the process by which a fabric is prepared by the interlooping of one or more yarns. Knits tend to have more stretch and resilience than wovens. Knits tend to be less durable than wovens. As in the case of wovens, there are many knit patterns, and styles of knitting. According to the present invention, in one embodiment the fabric hereof is a knit fabric comprising yarns comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055. In one embodiment, the poly(trimethylene arylate) is poly(trimethylene terephthalate).

Further contemplated in the present invention are garments sewn from fabrics of the invention. The garments hereof comprise a fabric comprising yarns comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055. In one embodiment, the poly(trimethylene arylate) is poly(trimethylene terephthalate).

The fabrication of garments from fabrics is extremely well-known art. The preparation of a garment from a fabric includes preparing a pattern, usually from paper, or in computerized form for automated processes, measuring the required fabric pieces, cutting the fabric to prepare the needed pieces, and then sewing the pieces together according to the pattern. A garment may be made exclusively one or more styles of the fabric of the invention. Alternatively, a garment may be prepared by combining one or more styles of the fabric of the invention with other fabrics.

The invention is further described in the following specific embodiments, but is not limited thereto.

EXAMPLES

Test Methods

Intrinsic Viscosity

The intrinsic viscosity (IV) of the PTT was determined using a Viscotek Forced Flow Viscometer Y900 (Viscotek Corporation, Houston, Tex.) Following the procedures of ASTM D-5225-92, a 0.4 g/dl solution of PTT was formed in a 50/50 weight % solvent mixture of trifluoroacetic acid and methylene chloride at 19° C. and the viscosity determined. These measured IV values were correlated to IV values measured manually in 60/40 weight % phenol/1,1,2,2-tetrachloroethane following ASTM D 4603-96.

Number Average Molecular Weight

The number average molecular weight of polystyrene was determined following ASTM D 5296-97. The same method was used for poly(trimethylene terephthalate) except that the calibration standard was a poly(ethylene terephthalate) with an $M_w$ of 44,000 and hexafluoroisopropanol solvent.

Tenacity and Elongation at Break

The physical properties of the filaments and yarns were measured using an Instron Corp. tensile tester, model no. 1122. More specifically, elongation to break, $E_b$, and tenacity were measured according to ASTM D-2256.

Spinning Campaigns and Spinning Machine Affect on Results

Fiber spinning was performed in four separate campaigns. As described in greater detail infra, Campaigns #1, 3, and 4 were executed on Spinning Machine #2, while Campaign #2 was executed on Spinning Machine #1.

Figure 5:
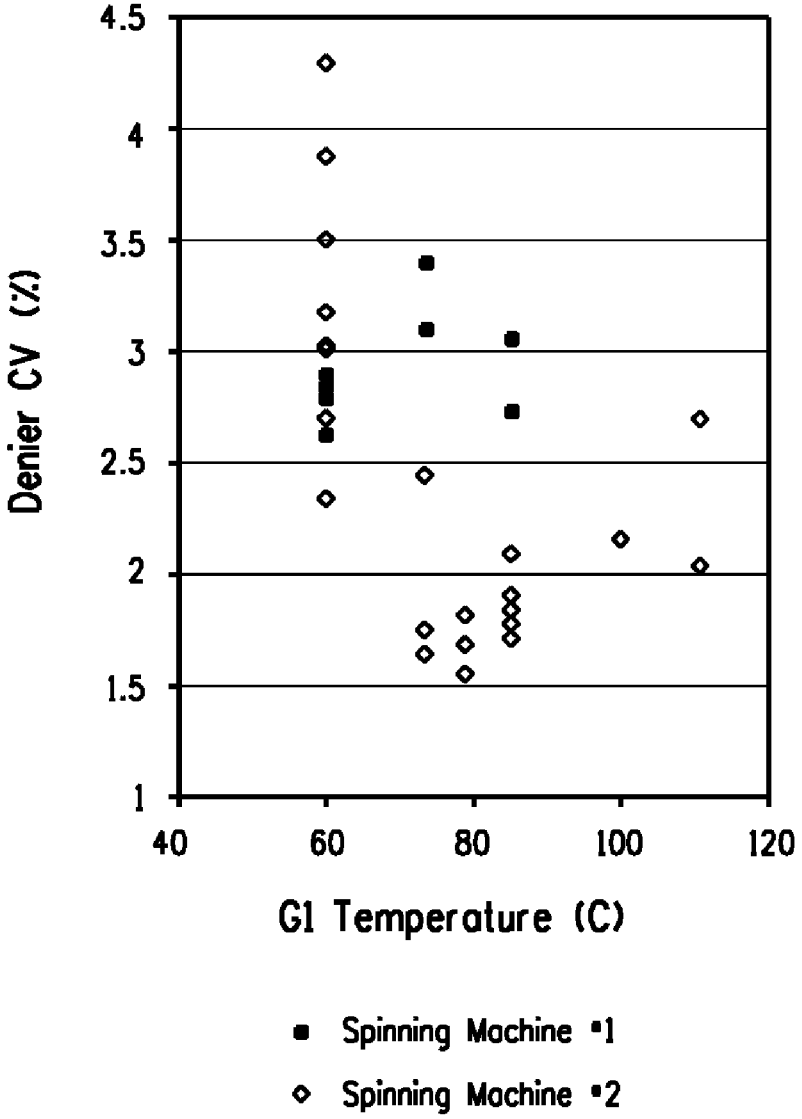
FIG. 5 is a graph of the experimental results, showing the effect of the temperature of the first godet on the denier coefficient of variation, and contrasting the results obtained using Spinning Machine #2 with those obtained using Spinning Machine #1.

The results obtained from Spinning Machine #1 were scattered, as shown in Table 4 and FIG. 5, and are not considered definitive. In particular, the denier coefficient of variation was higher than the limit as specified in the invention, and did not appear to vary systematically with the temperature of the first godet FIG. 5 is a graph showing the denier CV versus first godet temperature wherein all of the data obtained from Campaigns 1, 3, and 4 are combined together and plotted with a diamond shape, and the data from Campaign #2 is graphed using a triangle shape. As shown in Tables 3-6, infra, not all data points obtained in the three campaigns wherein Spinning Machine #2 was employed were obtained using the same set of spinning conditions. Nevertheless, as seen in FIG. 5, the data from Spinning Machine #2, shown as diamond shapes, showed a clear trend, where first godet temperature in the range of ca. 75 to 85° C. corresponded to a minimum in denier CV. A similar trend was not observed in the data of Campaign #2.

Denier coefficient of variation is a measurement of short distance denier variability, which is in turn, an indicator of the stability of the melt spinning process. The melt spinning process can be unstable because the spinning composition causes an instability. It can also be unstable because the machine is unstable. It is clear from FIG. 5 that in this case the high denier CV produced in Campaign #2 was an artifact of the machine performance and design.

Spinning Machine #1 was a laboratory-built spinning machine provided with only the most basic equipment to effect melt spinning. Spinning Machine #1 was employed normally only to obtain the most basic information about whether or not experimental compositions were capable of being melt-spun into fiber. It was employed in Campaign #2 herein because of a scheduling mix-up—Spinning Machine #2 was not available on the day scheduled for Campaign #2. Spinning Machine #2 was a pilot plant spinning line. Conditions thereon were fully scalable to full-size commercial scale spinning lines. This was the spinning line of choice for demonstrating the differences in results that are characteristic of the invention.

Figure 4:
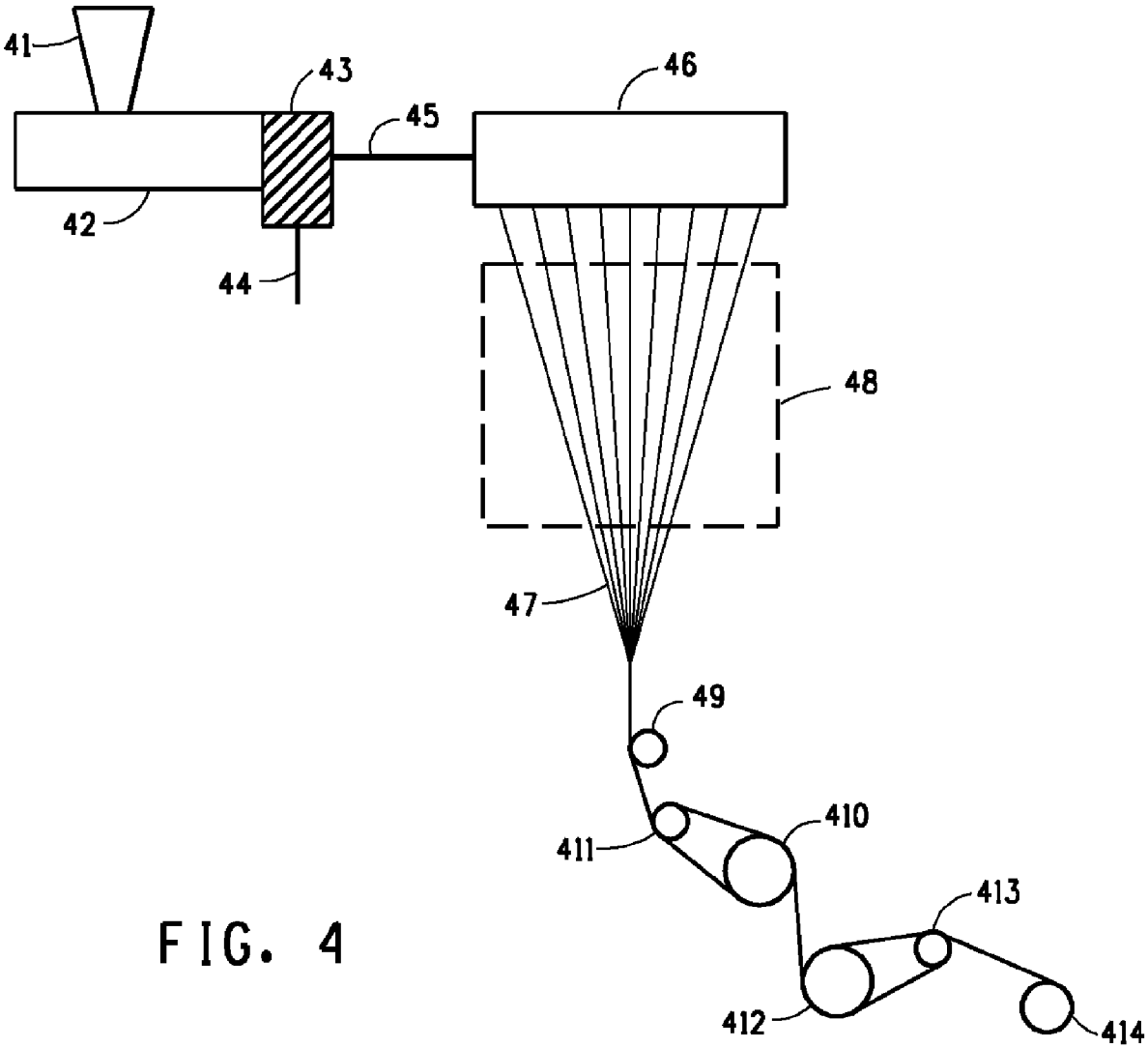
FIG. 4 is a schematic representation of the spinning machines employed in the Examples.

FIG. 4 schematically depicts Spinning Machine #2. A silo drier, 41, gravity fed a single screw extruder, 42, with dried resin blend pellets. The output of the single screw extruder, 42, was fed directly, under pressure, to the input of a gear pump, 43, provided with an overflow port, 44. The output of the gear pump was supplied via a short (inches long) transfer line, 45, to a six end spin pack, 46 of which four ends were used. Each of four threadlines, 47 (one shown), was extruded from a 36 hole spinneret, (not shown) whereof each hole was characterized by a round cross-section of 0.27 mm diameter and 0.50 mm in length. Each threadline, 47, passed through a cross-flow quench air zone approximately 1.75 m in length, 48, with ambient air flowing across the threadline from one side to another in campaign 1 and a radial quench air zone approximately 1.75 m in length, 48, with ambient air flowing radially around the threadline to produce even more uniform filaments in campaigns 3 and 4. Each thus quenched threadline was contacted to a finish roll, 49, and then wrapped 6-8 times around a first heated godet (feed roll), 410, and a corresponding first separator roll, 411, to keep the threadlines apart. The threadline was then directed to a second heated godet (draw roll), 412, and a second corresponding second separator roll, 413, through an interlace jet (not shown) and thence to a windup, 414. Also not shown, each Godet was partially enclosed by a hot chest to maintain temperature. The extruder was provided with 3 heating zones, and a head zone at the output.

Spinning Machine #1 and Spinning Machine #2 were substantially the same in regard to the layout described in FIG. 4. Once difference was that the quench air chimney in Spinning Machine #1 was much narrower than its counterpart on Spinning Machine #2.

In all the Examples and Comparative Examples, the average results for four threadlines spun simultaneously under each set of conditions are reported. The spinning machines were allowed to reach steady state after a change in set-point conditions by running for ca. 45 minutes before a test sample was prepared. When the composition of the polymer was changed, the spinning machine was purged with PTT not containing PS. When the spinneret was changed, the machine was purged in between spinning experiments.

Preparation of Polymer Blends

Samples of PS in PTT (0.8 and 0.55 wt %) were made by co-feeding dried PTT and PS to a 30 mm T/S extruder. Sorona®Semi-Dull PTT resin pellets (1.02 IV available from the DuPont Company, Wilmington, Del.) polytrimethylene terephthalate was combined with polystyrene (168 M KG 2 available from BASF) pellets in the amounts shown in Table 1. The PTT was dried in a vacuum oven with a nitrogen purge at 120° C. for 14 hours prior to use. The two polymers were individually weight-loss fed to the fourth barrel section of a Werner & Pfleiderer ZSK-30 counter-rotating twin screw extruder. The feed rates employed are shown in Table 1 in pounds per hour (pph). The extruder had a 30 mm diameter barrel constructed with 13 barrel sections provided in alternating arrangement with two kneading zones and three conveying sections, the extruder having an L/D ratio of 32. Each barrel section was independently heated. Sections 1-4 were set at 25° C., Sections 5-13 were set at 210° C., the 3/16" strand die was also set at 210° C. A vacuum was applied to barrel segment 8. Table 1 also shows the composition of the feed, the rate of output, and the melt temperature. The extrudate was quenched in water immediately upon exiting the die and was then pelletized using standard pelletizing equipment into 1/8" pellets.

TABLE 1

| Polymer Blend # | Compostion (% PS) | PS Set Feed Rate (pph) | PTT Set Feed Rate (pph) | Output Rate (pph) | Melt Temperature (° C.) |
|---|---|---|---|---|---|
| 1 | 0.80 | 0.32 | 39.68 | 40.00 | 260 |
| 2 | 0.55 | 0.22 | 39.78 | 40.00 | 260 |

Melt Spinning

Melt spinning of fiber was conducted in four separate spinning campaigns as described infra. Table 2 shows the spinning parameters that were held constant during each campaign.

TABLE 2

Fixed Spinning Parameters by Campaign

| Campaign #: | 1 | 2 | 3 | 4 |
|---|---|---|---|---|
| Spinning Machine | 2 | 1 | 2 | 2 |
| [PS] | Variable | 0.80 | 0.80 | 0.80 |
| Capillary Diameter (mm) | 0.27 | Variable | 0.27 | 0.27 |

TABLE 2-continued

Fixed Spinning Parameters by Campaign

| Campaign #: | 1 | 2 | 3 | 4 |
|---|---|---|---|---|
| Polymer Flow Rate (g/min) | 37.5 | 37.5 | Variable | 37.5 |
| Quench | Cross-Flow | Cross-Flow | Radial | Radial |
| Second Godet Speed (rpm) | 4500 | 4500 | Variable | 4500 |
| Second Godet Temperature (° C.) | 110 | 110 | 110 | 110 |

Campaign #1—Spinning Machine #2

The melt compounded pellets of the PTT/PS blend so prepared were dried in a drying silo overnight at 140° C. to lower the moisture content to <50 ppm. The dried melt blends were gravity fed to the single screw extruder described supra, in FIG. 4, of Spinning Machine #2. Extruder set points, in ° C., in zones 1-3 were respectively 230/255/263. The extruder output was melt-fed to the spin pack through a gear pump. The spin pack was provided with six spinning positions of which four were provided with spinnerets each spinneret having 36 holes, each hole being 0.27 mm in diameter and 0.5 mm in length, and of circular cross-section. Each yarn so produced was a 75 denier 36 filament yarn. The settings of the first godet roll are shown in Table 3. Note that the second godet roll was maintained at 110° C. and 4500 rpm. The quench air was a cross-flow quench with an air velocity of 0.35 cm/s.

The protocol that was followed was as follows: The second godet roll (draw roll) was set at 4500 m/min and 110° C., and was not changed in the course of the experiments. Experiments were then conducted with the first godet roll (feed roll) set at 60° C. and the speed was varied in order to identify a draw ratio that resulted in the highest tenacity when elongation to break was adjusted to be in the range of 55-65%. For Polymer Blend #2 (0.055% PS) a draw ratio of 2.09 was found to result in the highest tenacity when elongation to break was within the desired range (i.e., the feed roll was set at 2150 m/min). Spinning was then continued at additional feed roll temperatures of 85 and 110° C. The same procedure was followed for Polymer Blend #1 (0.8% PS); a draw ratio of 2.37 was found to result in the highest tenacity when elongation to break was within the desired range (i.e., feed roll speed=1900 m/min).

Results are shown in Table 3

TABLE 3

Results of Campaign #1

| Example | PS conc (wt %) | G1 Speed (m/min) | G1 Temp (° C.) | Draw Ratio (G2/G1) | DPF (g/9000 m) | Denier CV (%) |
|---|---|---|---|---|---|---|
| Comp. Ex. A | 0.80 | 2150 | 60 | 2.09 | 2.0 | 3.50 |
| Comp. Ex. B | 0.80 | 1900 | 60 | 2.37 | 2.0 | 3.19 |
| Comp. Ex. C | 0.80 | 1750 | 60 | 2.57 | 2.1 | 3.01 |
| Ex. 1 | 0.80 | 1900 | 85 | 2.37 | 2.0 | 1.78 |
| Ex. 2 | 0.80 | 1900 | 110 | 2.37 | 2.0 | 2.02 |
| Comp. Ex. D | 0.55 | 2300 | 60 | 1.96 | 2.1 | 2.71 |
| Comp. Ex. E | 0.55 | 2150 | 60 | 2.09 | 2.1 | 3.83 |
| Ex. 3 | 0.55 | 2150 | 85 | 2.09 | 2.1 | 2.07 |
| Ex. 4 | 0.55 | 2150 | 110 | 2.09 | 2.0 | 2.69 |

Campaign #2—Spinning Machine #1

A new melt blend of 0.80% by weight in PTT identical to that of Blend #1 supra. The melt compounded pellets of the PTT/PS blend so prepared were dried in a drying silo overnight at 140° C. to lower the moisture content to <50 ppm. The dried melt blend pellets were gravity fed to the single screw extruder described supra, in FIG. 4, of Spinning Machine #1. Extruder set points, in ° C., in zones 1-3 were respectively 230/255/263. The extruder output was melt-fed to the spin pack through a gear pump. The spin pack was provided with six spinning positions of which four were provided with spinnerets each spinneret having 36 holes, each hole being 0.27 mm in diameter and 0.5 mm in length, and of circular cross-section. Each yarn so produced was a 75 denier 36 filament yarn. The settings of the first godet roll are shown in Table 4. Note that the second godet roll was maintained at 110° C. and 4500 rpm. The quench air was a cross-flow quench with an air velocity of 0.35 cm/s.

The protocol that was followed was as follows: The second godet roll (draw roll) was set at 4500 m/min and 110° C., and was not changed in the course of the experiments. Experiments were then conducted with the first godet roll (feed roll) set at 60° C. and the speed was varied in order to identify a draw ratio that resulted in the highest tenacity when elongation to break was adjusted to be in the range of 55-65%. The followed for Polymer Blend #1 (0.8% PS) was: a draw ratio of 2.37 was found to result in the highest tenacity when elongation to break was within the desired range (i.e., first godet roll speed=1900 m/min).

Examples 5 and 6 were performed with spinneret orifices 0.27 mm in diameter. Examples 7 and 8 were performed with spinneret orifices 0.32 mm in diameter. Other spinning conditions are shown in Table 2 and Table 4. Results are shown in Table 4.

TABLE 4

Results of Campaign #2

| Example | Capillary D (mm) | G1 Speed (m/min) | G1 Temp (° C.) | Draw Ratio (G2/G1) | DPF (g/9000 m) | Denier CV (%) |
|---|---|---|---|---|---|---|
| Comp. Ex. F | 0.27 | 2150 | 60 | 2.09 | 2.1 | 2.80 |
| Comp. Ex. G | 0.27 | 1900 | 60 | 2.37 | 2.1 | 2.82 |
| Comp. Ex. H | 0.27 | 1750 | 60 | 2.57 | 2.1 | 2.79 |
| Ex. 5 | 0.27 | 1900 | 73 | 2.37 | 2.1 | 3.11 |
| Ex. 6 | 0.27 | 1900 | 85 | 2.37 | 2.1 | 2.74 |

TABLE 4-continued

Results of Campaign #2

| Example | Capillary D (mm) | G1 Speed (m/min) | G1 Temp (° C.) | Draw Ratio (G2/G1) | DPF (g/9000 m) | Denier CV (%) |
|---|---|---|---|---|---|---|
| Comp. Ex. I | 0.32 | 2150 | 60 | 2.09 | 2.0 | 2.62 |
| Comp. Ex. J | 0.32 | 1900 | 60 | 2.37 | 2.1 | 2.79 |
| Comp. Ex. K | 0.32 | 1750 | 60 | 2.57 | 2.1 | 2.88 |
| Ex. 7 | 0.32 | 1900 | 73 | 2.37 | 2.1 | 3.39 |
| Ex. 8 | 0.32 | 1900 | 85 | 2.37 | 2.1 | 3.06 |

Campaign #3—Spinning Machine #2

The same batch of PS/PTT containing 0.80% by weight PS as employed in Campaign #2 was employed.

Melt spinning was effected using the same spinning machine procedures and settings as described for Campaign #1, supra, except that in these examples a 75 denier/36 filament yarn was spun and the quench was a radial quench. Spinning conditions are shown in Table 3 and Table 5. Again the extruder heating zones were set respectively to 230/255/263° C. Spinneret diameter was 0.27 mm. Flow rates were controlled to 37.5 g/min. Results are shown in Table 5.

TABLE 5

Results of Campaign #3

| Example | G1 Speed (m/min) | G1 Temp (° C.) | Draw Ratio (G2/G1) | DPF (g/9000 m) | Denier CV (%) |
|---|---|---|---|---|---|
| Comp. Ex. L | 1550 | 60 | 2.90 | 2.0 | 4.27 |
| Comp. Ex. M | 1450 | 60 | 3.10 | 2.1 | 3.04 |
| Comp. Ex. N | 1350 | 60 | 3.33 | 2.1 | 2.32 |
| Ex. 14 | 1450 | 73 | 3.10 | 2.1 | 2.45 |
| Ex. 15 | 1350 | 73 | 3.33 | 2.1 | 1.64 |
| Ex. 16 | 1450 | 85 | 3.10 | 2.1 | 1.90 |
| Ex. 17 | 1350 | 85 | 3.33 | 2.1 | 1.72 |
| Ex. 18 | 1350 | 100 | 3.33 | 2.1 | 2.15 |

Campaign #4—Spinning Machine #2

A third blend of 0.8% PS in PTT was made in a manner identical to that of Blend #2, described supra.

Melt spinning was effected using the same spinning machine procedures and settings as described for Campaign #3, supra, except that in these examples a 75 denier/72 filament yarn was spun. Spinning conditions are shown in Table 3 and Table 6. Again the extruder heating zones were set respectively to 230/255/263° C. Spinneret diameter was 0.27 mm. Flow rates were controlled to 37.5 g/min except where noted in Ex 12 and Ex 13. Results are shown in Table 6.

TABLE 6

Results of Campaign #4

| Example | Flowrate (g/min) | G1 Speed (m/min) | G1 Temp (° C.) | G2 Speed (m/min) | Draw Ratio (G2/G1) | DPF (g/9000 m) | Denier CV (%) |
|---|---|---|---|---|---|---|---|
| Ex. 9 | 37.5 | 1550 | 73 | 4500 | 2.90 | 1.1 | 1.73 |
| Ex. 10 | 37.5 | 1550 | 79 | 4500 | 2.90 | 1.0 | 1.69 |
| Ex. 11 | 37.5 | 1550 | 85 | 4500 | 2.90 | 1.0 | 1.83 |
| Ex. 12 | 35.4 | 1400 | 79 | 4250 | 3.04 | 1.0 | 1.55 |
| Ex. 13 | 39.6 | 1750 | 79 | 4750 | 2.71 | 1.0 | 1.84 |

What is claimed is:

1. A fabric comprising a filament comprising a composition comprising 0.1 to 3% by weight of polystyrene, based on the total weight of the polymer in the composition, dispersed in poly(trimethylene arylate) wherein the filament is characterized by a denier per filament of ≤3, a denier coefficient of variation of ≤2.5% and a birefringence of at least 0.055.

2. The fabric of claim 1 wherein the poly(trimethylene arylate) is poly(trimethylene terephthalate).

3. The fabric of claim 1 wherein the composition comprises 0.5 to 2% by weight of polystyrene, based on the total weight of the polymer in the composition, dispersed in poly(trimethylene arylate).

4. The fabric of claim 3 wherein the composition consists essentially of 0.5 to 2% by weight of polystyrene, based on the total weight of the polymer in the composition, dispersed in poly(trimethylene arylate).

5. The fabric of claim 2 wherein the composition comprises 0.5 to 2% by weight of polystyrene, based on the total weight of the polymer in the composition, dispersed in poly(trimethylene terephthalate).

6. The fabric of claim 2 wherein the composition consists essentially of 0.5 to 2% by weight of polystyrene, based on the total weight of the polymer in the composition, dispersed in poly(trimethylene terephthalate).

7. The fabric of claim 1 wherein the fabric is a woven.

8. A garment comprising the fabric of claim 1.

* * * * *